US005217354A

United States Patent [19]

Neward

[11] Patent Number: 5,217,354

[45] Date of Patent: Jun. 8, 1993

[54] HAND-HELD VACUUM AND PRESSURE PUMP WITH IMPROVED HANDLE

[76] Inventor: Theodore C. Neward, 9251 Archibald Ave., Rancho Cucamonga, Calif. 91730

[21] Appl. No.: 931,686

[22] Filed: Aug. 18, 1992

[51] Int. Cl.[5] ..... G05G 7/16

[52] U.S. Cl. ..... 417/437; 417/544; 74/523; D8/14.1

[58] Field of Search ..... 74/522.5, 523, 524, 74/525; D8/14.1; 417/437, 566, 571, 544; 222/323, 324, 336, 339

[56] References Cited

U.S. PATENT DOCUMENTS 2,833,451 5/1958 Sherbondy ..... D8/14.1
4,954,054 9/1990 Neward ..... 417/566 X

FOREIGN PATENT DOCUMENTS 2312523 9/1974 Fed. Rep. of Germany ..... 74/523
2138924 10/1984 United Kingdom ..... 74/523

*Primary Examiner*—Richard E. Gluck
*Attorney, Agent, or Firm*—Lyon & Lyon

[57] ABSTRACT

The device of the present application, a hand held vacuum and pressure pump having an improved handle, provides a hand held pump with a handle suitable to be used by a person with a smaller hand without significant loss of stroke length or leverage. The handle having a movable arm which is compressible toward a fixed arm, at least one of the arms having an angled corner such that distal ends of the arms when not compressed are closer together than they would be without the corner, and at least one of the arms having a taper at the distal end of the arm such that the arms may compress together in a full stroke.

12 Claims, 1 Drawing Sheet

HAND-HELD VACUUM AND PRESSURE PUMP WITH IMPROVED HANDLE

FIELD OF THE INVENTION

The present invention relates to vacuum and pressure pumps, particularly hand-held vacuum and pressure pumps.

BACKGROUND

Hand-held vacuum and pressure pumps are generally useful whenever vacuum or pressure is desired. Vacuum or pressure can be created, for example, by compressing (i.e. squeezing) and releasing a handle of such a vacuum and pressure pump. Generally, such squeezing and releasing causes a piston to move in a vacuum or pressure device of the pump thereby creating vacuum or pressure. Such hand-held vacuum and pressure pumps are especially useful for performing vacuum extractions during childbirth. They are also useful in the automotive industry for liquid sampling and vacuum system testing and repair.

U.S. Pat. Nos. 3,612,722, 4,775,302, 4,806,084, and 4,954,054, all issued to the present applicant, disclose hand-held vacuum and pressure pumps with compressible handles. The disclosures of these patents are incorporated herein by reference.

Generally, hand-held vacuum and pressure pumps of the prior art provide vacuum or pressure through repeatedly compressing the handles of such pumps in a stroke. Compressing the handle in a full stroke is necessary to provide the most efficient vacuum or pressure per stroke. The more the handles move per stroke the more they in turn move a piston in a cylinder which creates the vacuum or pressure. The more the piston moves in the cylinder per stroke the more vacuum or pressure is provided per stroke. It is most efficient in both time and work to provide the greatest vacuum or pressure per stroke and, therefore, to compress the handles in a full stroke.

Unfortunately, handles of the pumps of the prior art may be too large and awkward for a person with a small hand to perform the necessary full and efficient stroke. However, decreasing the size of pump handles to better fit a small hand may result in a shorter or lessened stroke and, therefore, provide a smaller or lessened amount of vacuum or pressure per stroke thereby decreasing efficiency. In addition, decreasing the size of such handles may also result in lessened leverage (due to shorter handles) thereby increasing the difficulty of compressing the handles and, therefore, decreasing efficiency.

It is therefore an object of the invention to provide a hand-held vacuum and pressure pump having a compressible handle designed for use by a person with a small hand.

It is a further object of the invention to provide a hand-held vacuum and pressure pump having a compressible handle designed for use by a person with a small hand yet capable of attaining a full stroke.

It is an additional object of the invention to provide a compressible hand-held vacuum and pressure pump having a handle designed for use by a person with a small hand without shortening the handle and without suffering a loss of leverage due to shortening the handle.

It is another object of the invention to provide a hand-held vacuum and pressure pump having a compressible handle designed for use by a person with a small hand and further designed to impede a user's hand from slipping along or off the end of the handle.

SUMMARY OF THE INVENTION

The present invention comprises a vacuum and pressure pump with an improved handle which allows efficient, comfortable, and easy use by persons with small hands. The present invention provides a vacuum and pressure pump having a compressible handle comprising a first arm and a second arm. The handle is designed such that at least one arm of the handle has an angled section between proximal and distal parts of the arm which is angled such that the distal part of the arm is closer to the second arm of the handle than it would be without the angled section. The angled section is designed such that a pump having a handle with such an angled section is more easily manipulated by a person with a small hand than is a pump of the prior art (i.e. a pump not having a handle with such an angled section).

The present invention also provides a vacuum and pressure pump having a handle as above and with a taper on a distal end of at least one of the arms of the handle. The taper is designed such that upon compressing the arms of the handle of the pump in a stroke the handle may be compressed in a substantially full stroke. The taper lessens or eliminates any loss of efficiency or of stroke length due to one arm of the handle being angled closer to the other arm of the handle. Furthermore, the taper and corner are designed such that there is no need to shorten the handle to allow for full and efficient strokes. Therefore, there is no loss of leverage due to such shortening. In addition, the pump of the present invention may have a handle as above and with a knob or bump at the distal end of an arm of the handle such that the knob or bump impedes a user's hand from slipping down or off the handle.

These and other aspects of the present invention will become clearer after an examination of the drawings, a detailed description, and the claims herein.

DETAILED DESCRIPTION OF THE PREFERRED EMBODIMENT

Figure 1:
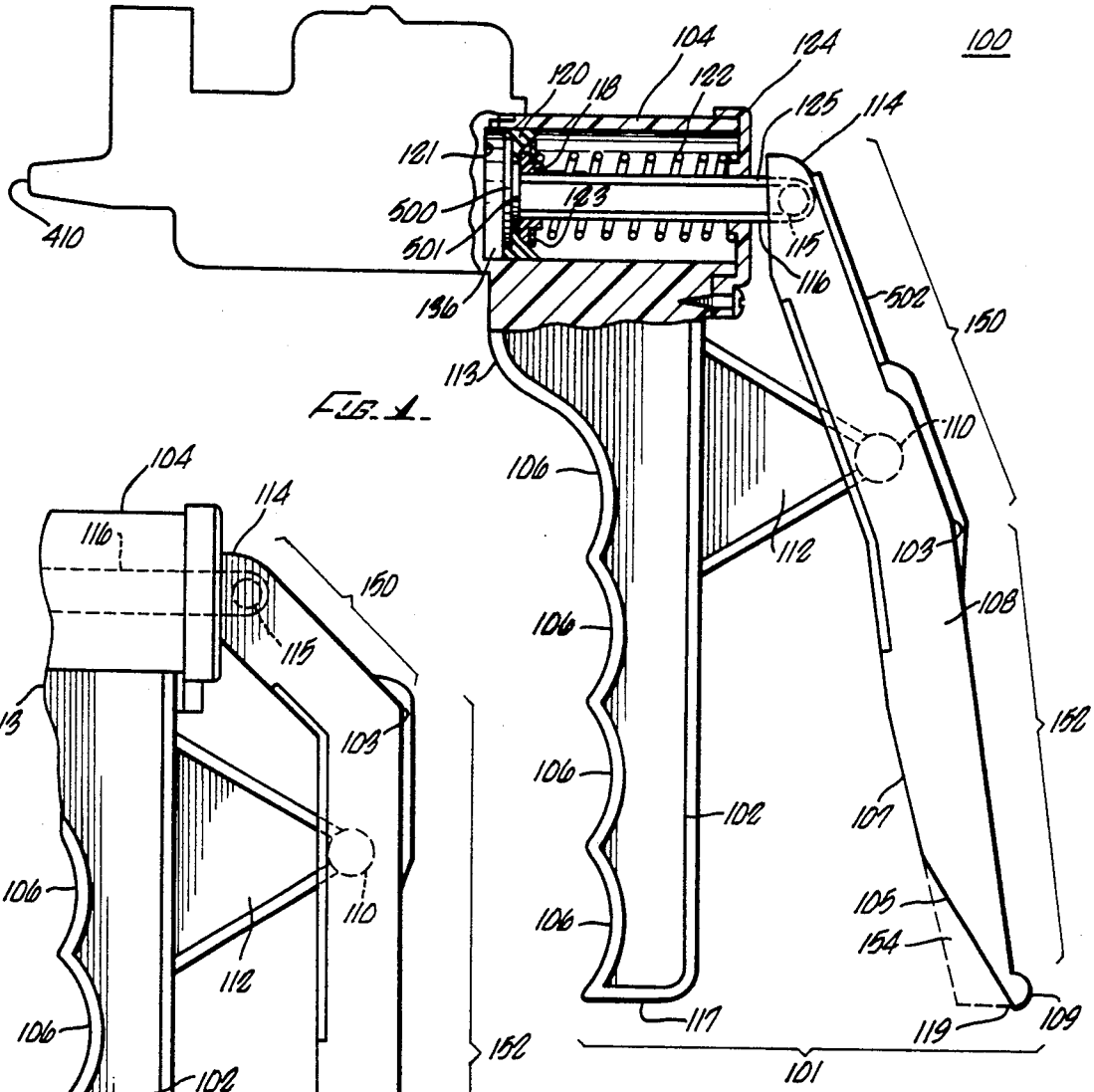
FIG. 1 is a cutaway side view of a vacuum and pressure pump having an improved handle, showing the improved handle having an angled corner in an arm of the handle below a pivot point on the arm and a taper at the distal end of that arm, and showing a conventional vacuum and pressure pumping mechanism.
Figure 2:
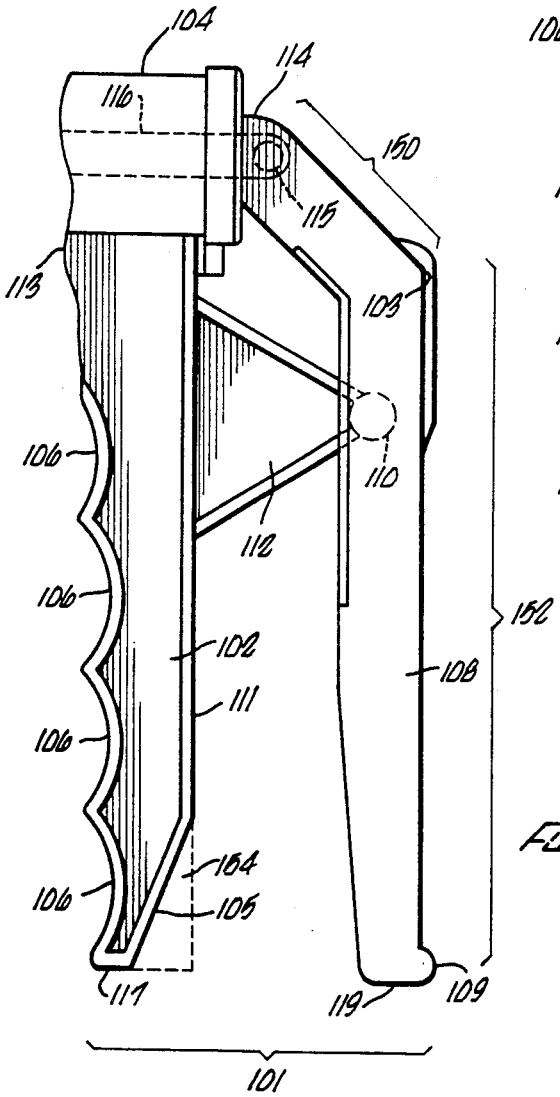
FIG. 2 is a side view of a second embodiment of an improved handle of a vacuum and pressure pump, showing the improved handle having an angled corner in an arm of the handle above a pivot point on the arm and a taper at the distal end of a second arm.

Referring to the figures, the present invention, a vacuum and pressure pump 100, has an improved compressible handle 101 which includes a first arm 102 having a proximal end 113 and a distal end 117. (FIG. 2 shows only a second embodiment of the handle 101 of the present invention.) The first arm 102 is attached and fixed at its proximal end 113 to a sealed cylinder 104. The fixed arm 102 and cylinder 104 form a body of the vacuum and pressure pump 100 (described more fully below). The fixed arm 102 is preferably shaped to include indentations 106 for the fingers of an operator's hand. The fixed arm 102 also includes a support 112 attached thereto. The support 112 has a pivot 110. The handle 101 of the pump 100 includes a second arm 108 which is movably attached to the support 112 of the fixed arm 102 at the pivot 110. The movable arm 108 includes a proximal end 114 which is coupled via a joint 115 to a piston rod 116 of a conventional vacuum and pressure pumping mechanism. Manipulation of the movable arm 108 causes operation of the piston rod 116 in the cylinder 104 which in turn creates vacuum or pressure at port 410 (FIG. 1).

The vacuum and pressure pump portion of the present invention is conventional and well known in the art. The pump comprises a piston rod 116 which extends into the cylindrical chamber 104 and terminates in a cylindrical piston cap 118 with a resilient cylindrical piston 120 disposed thereon. The cap 118 and piston 120 are shown slightly drawn back from an inner end 121 of the cylindrical chamber 104. The cap 118 has at its leading end a small disc formation 501 ahead of which is a larger disc formation 500. The piston 120 is pressed to the inner end 121 of the cylinder 104 by a spring 122. One end of the spring 122 bears against a cap 124 secured to the outer end of the cylinder 104, and the other end of the spring 122 bears against a spreader ring 123. The spring 122 presses against the spreader ring 123 which in turn presses against the piston 120 to thereby improve the seal between the piston 120 and the cylinder 104. When the arms 102 and 108 are squeezed, the piston 120 is drawn back. When the arms are released, the spring 122 forces the piston 120 to return to the inner end 121 of the cylinder 104.

When the piston 120 is drawn back, air will be drawn from port 410 of the pump 100 into the area 136 evacuated by piston 120 creating a differential pressure at the port 410. When the arm 108 is released the spring loaded piston 120 returns to the inner end 121 of the cylindrical chamber 104 and the evacuated air is force out of the pump 100 via a conventional valving mechanism (not shown). It can be easily seen that repeated squeezing and releasing of the arm 108 will result in air being evacuated from the port 410 area and a high vacuum can be generated.

The pump 100 may also be used to create pressure at port 410 by conventional means. For pressure pump operability it is necessary that the spring 122 is strengthened over a spring 122 normally operable as only a vacuum pump. To facilitate the generation of a pressure there is located a pressure pad 502 at a location opposite the piston for exerting thumb pressure on the end of the piston to assist in urging its forward movement. The construction and operation of the remainder of the pump interior is fully disclosed in U.S. Pat. No. 4,954,054 the disclosure of which is incorporated herein by reference.

The movable arm 108 includes a proximal portion 150 and a distal portion 152 joined at an angled section or corner 103. The corner 103 is designed such that an angle would be formed between a line extending along and beyond proximal portion 150 and a second line extending along and beyond distal portion 152. The angled corner 103 causes the distal portion 152 of the moveable arm 108 to be closer to the fixed arm 102 than it would be without the angled corner 103. The corner 103 may be sharp or rounded.

At least one of the arms 108 and 102 includes a taper 105 at the distal end 117 and 119 of the arms 108 and 102. The taper 105 may be located on a side 107 of the movable arm 108 which is toward the fixed arm 102 (as shown in FIG. 1) or may be located on a side 111 of the fixed arm 102 which is toward the movable arm 108 (as shown in FIG. 2). The taper 105 allows the arms 102 and 108 to be compressed, or squeezed, toward each other in a stroke which is fuller than would be possible without the taper 105.

The taper 105 and the angled corner 103 act cooperatively to allow the handle 101 of the pump 100 to be more suitable for a smaller hand and yet maintain efficiency of use. First, the angled corner 103 causes the distal portion 152 of moveable arm 108 to be closer to the fixed arm 102 prior to compressing the handle 101 and, therefore, allow a smaller hand to more easily fit around and manipulate (i.e. compress) the handle 101. Second, although the distal portion 152 of movable arm 108 is closer to the fixed arm 102, the taper 105 allows the handle 101 to be compressed in a substantially or completely full stroke and, therefore, efficiency is substantially or completely maintained per stroke.

Basically, the corner 103 and the taper 105 act cooperatively in that, when the arms 102 and 108 of the handle 101 are compressed toward each other, the taper 105 allows the arms 102 and 108 to compress past a point where a portion 154 of the arms (shown in phantom in the figures for purposes of explanation) would physically prevent full compression if it were there. Therefore, the taper 105 allows full compression of the arms 102 and 108 and, therefore, full motion of the piston rod 116 in cylinder 104 of the pump 100. The taper 105 may be introduced independent of, or in addition to, angled corner 103, to provide a stroke that is longer than the stroke possible without it.

In addition, the movable arm 108 may include a knob or bump 109 at the distal end 119 of the arm 108. The knob or bump is designed and situated to impede a user's hand from slipping down or off the handle 101 of the pump 100. A knob or bump (not shown) may be located at the distal end of fixed arm 102 in addition to or instead of the knob or bump 109 on the movable handle 108.

Turning to FIG. 2 in more detail, a second embodiment of the pump 100 is shown wherein the angled corner 103 between the proximal portion 150 and the distal portion 152 of movable arm 108 is between joint 115 and pivot 110. (Compare FIG. 1 where the angled corner 103 is between the pivot 110 and the distal end 119 of the movable arm 108.) The corner 103 could also be at or adjacent to the pivot 110.

FIG. 1 shows that the present invention includes a conventional vacuum and pressure pump assembly which may be any assembly of the type known to those familiar with the art. As mentioned above, an vacuum and pressure pump assembly that would be appropriate for incorporation into the device of the present invention is fully disclosed in U.S. Pat. No. 4,954,054 the disclosure of which is incorporated herein by reference.

The present embodiments of this invention are to be considered in all respects as illustrative and not restrictive, the scope of the invention being indicated by the appended claims rather than by the foregoing description, and all changes which come within the meaning and range of equivalency of the claims are intended to be embraced therein.

What is claimed is:

1. A hand held pump having a cylinder with a piston attached thereto and having a handle comprising a fixed arm having a support attached thereto, and having proximal and distal ends, the proximal end of the fixed arm attached to the cylinder, and a movable arm having proximal and distal ends, having a proximal portion at the proximal end, a distal portion of the distal end, and a central angled portion therebetween, the distal portion having a taper at the distal end, the movable arm being pivotably attached to the support so the distal portion of the movable arm may pivot toward the fixed arm, the proximal end of the movable arm being attached to the piston, the central angled portion allows the distal end of the movable arm when the movable arm is not pivoted to lie closer to the fixed arm than it would without the central angled portion, and the taper enabling the movable arm to compress toward the fixed arm in a substantially full stroke.

2. The hand held pump of claim 1 wherein the central angled portion is located between the support and the distal end of the movable arm.

3. A hand held pump having a cylinder with a piston attached thereto and having a handle comprising a fixed arm having a support attached thereto, having proximal and distal ends, and having a taper at the distal end, the proximal end of the fixed arm being attached to the cylinder, and a movable arm having proximal and distal ends, having a proximal portion at the proximal end, a distal portion at the distal end, and a central angled portion therebetween, the movable arm being pivotably attached to the support so the distal portion may pivot of the movable arm toward the fixed arm, the proximal end of the movable arm being attached to the piston, the central angled portion allowing the distal end of the movable arm when the movable arm is not pivoted to lie closer to the fixed arm than it would without the central angle portion, and the taper of the fixed arm enabling the movable arm to compress toward the fixed arm in a substantially full stroke.

4. The hand held pump of claim 1 wherein the movable arm further comprises a knob located at or near the distal end of said moveable arm such that an operator's hand is impeded from slipping along or off the handle of the pump.

5. The hand held pump of claim 1 wherein said fixed arm is shaped so as to conform to one or more fingers of an operator's hand.

6. A hand held pump having a cylinder with a piston attached thereto and having a handle comprising a first arm and a second arm each having proximal and distal ends, the cylinder attached to the proximal end of the first arm, the piston attached to the proximal end of the second arm, a support attached to the first arm, the second arm pivotably attached to the support so the distal end of the second arm may pivot toward the first arm, a central angle portion on the second arm being between the proximal and distal ends of the second arm allowing the distal end of the second arm when the second arm is not pivoted to lie closer to the first arm than it would without the central angled portion, and a taper on at least one of the distal end of the first arm and the distal end of the second arm for enabling the distal end of the second arm to pivot toward the first arm in a substantially full stroke.

7. The hand held pump of claim 6 wherein the central angled portion of the second arm is located between the support and the distal end of the second arm.

8. The hand held pump of claim 6 wherein the central angled portion of the second arm is located between the support and the proximal end of the second arm.

9. The hand held pump of claim 6 wherein the second arm further comprises a knob located at or near the distal end of said second arm such that an operator's hand is impeded from slipping along or off the handle of the pump.

10. The hand held pump of claim 6 wherein said first arm is shaped so as to conform to one or more fingers of an operator's hand.

11. The hand held pump of claim 6 wherein the taper is located on the distal end of the first arm.

12. The hand held pump of claim 6 wherein the taper is located on the distal end of the second arm.

* * * * *